US009984638B2

(12) United States Patent
Yang et al.

(10) Patent No.: US 9,984,638 B2
(45) Date of Patent: May 29, 2018

(54) HIGH REFRESH RATE DISPLAYS WITH SYNCHRONIZED LOCAL DIMMING

(71) Applicant: Apple Inc., Cupertino, CA (US)

(72) Inventors: Byung Duk Yang, Cupertino, CA (US); Kyung Wook Kim, Cupertino, CA (US); Shih Chang Chang, Cupertino, CA (US); Young-Jik Jo, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 87 days.

(21) Appl. No.: 14/828,849

(22) Filed: Aug. 18, 2015

(65) Prior Publication Data

US 2017/0053610 A1 Feb. 23, 2017

(51) Int. Cl.
*G09G 3/36* (2006.01)

(52) U.S. Cl.
CPC ..... *G09G 3/3648* (2013.01); *G09G 3/3611* (2013.01); *G09G 2300/023* (2013.01); *G09G 2320/103* (2013.01); *G09G 2340/0435* (2013.01)

(58) Field of Classification Search
None
See application file for complete search history.

(56) References Cited

U.S. PATENT DOCUMENTS 8,733,960 B2 5/2014 Seetzen et al.
8,860,657 B2 10/2014 Lee et al.
8,970,638 B2 3/2015 Kimura
2004/0155847 A1* 8/2004 Taoka ..... G09G 3/20 345/87
2006/0181503 A1* 8/2006 Feng ..... G09G 3/342 345/102
2008/0231579 A1* 9/2008 Vasquez ..... G09G 3/2092 345/98
2011/0043435 A1* 2/2011 Hebenstreit ..... G02B 26/005 345/5
2013/0063573 A1* 3/2013 Erinjippurath ..... G09G 3/003 348/51
2014/0198834 A1 7/2014 Wu et al.
(Continued)

FOREIGN PATENT DOCUMENTS

WO 2009113036 9/2009

*Primary Examiner* — Nalini Mummalaneni
*Assistant Examiner* — Parul Gupta
(74) *Attorney, Agent, or Firm* — Treyz Law Group, P.C.; Jason Tsai; Zachary D. Hadd

(57) ABSTRACT

A display may have a first stage such as a color liquid crystal display stage and a second stage such as a monochromatic liquid crystal display stage that are coupled in tandem so that light from a backlight passes through both stages. The first (upper) stage may be a high resolution display panel that is operated at a first refresh rate while the second (lower) stage is a low resolution display panel that is operated at a second refresh rate that is greater than the first refresh rate. In particular, the second stage may be configured to provide localized dimming that is synchronized to one or more moving objects in the video frames to be displayed to help reduce the perceived motion blur. The localized dimming may be provided via insertion of a black image portion that only overlaps with the moving objects, a blanking row that tracks the moving objects, a black frame, etc.

13 Claims, 11 Drawing Sheets

(56) References Cited

U.S. PATENT DOCUMENTS

2014/0225935 A1* 8/2014 Lee ..... G09G 3/3426
345/690
2015/0198834 A1* 7/2015 Wu ..... G02F 1/133514
349/61

* cited by examiner

HIGH REFRESH RATE DISPLAYS WITH SYNCHRONIZED LOCAL DIMMING

BACKGROUND

This relates generally to electronic devices and, more particularly, to electronic devices with displays. Electronic devices often include displays. For example, cellular telephones, computers, and televisions have displays.

Liquid crystal displays create images by modulating the intensity of light that is being emitted from a backlight. The perceived quality of a liquid crystal display is affected by its dynamic range. The dynamic range of a display is the ratio of the output of the display at its brightest setting to the output of the display at its dimmest setting. Because it is not possible to completely extinguish the light produced by the backlight in a liquid crystal display, the dynamic range of a liquid crystal display is limited. A typical liquid crystal display has a dynamic range of about 1000:1. When viewing content such as movies where dark areas are often present, the limited dynamic range of a conventional display can have an adverse impact on picture quality. For example, black areas of an image may appear to be dark gray rather than black.

It would therefore be desirable to be able to provide improved displays such as liquid crystal displays capable of outputting darker black areas.

SUMMARY

An electronic device may generate content that is to be displayed on a display. The display may be a liquid crystal display having an array of liquid crystal display pixels. Display driver circuitry in the display may display image frames on the array of pixels.

In accordance with an embodiment, a two-stage display is provided that includes a color upper stage having color filter elements, a monochromatic lower stage, and a timing controller that receives video signals, that identifies a moving object in the video signals, and that performs localized dimming that is synchronized with the moving object. The color upper stage is configured to operate at a first refresh rate while the monochromatic lower stage is configured to operate at a second refresh rate that is greater than the first refresh rate. For example, the color stage may operate at a 60 Hz refresh rate while the monochromatic stage operates at a 120 Hz refresh rate.

The localized dimming may be performed by inserting a black image portion into the monochromatic lower stage every other frame. The black image portion may track the position of the moving object only when a moving object is detected in the video signals. In one suitable arrangement, the insertion of the black image portion includes using the monochromatic stage to display a black object that overlaps with the moving object every other frame. In another suitable arrangement, the insertion of the black image portion includes using the monochromatic stage to display a black row that at least partially covers the moving object every other frame. In yet another suitable arrangement, the insertion of the black image portion comprises using the monochromatic stage to display a completely black image every other frame. Performing localized dimming that is synchronized to the moving object can help reduce the perceived motion blur.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Electronic devices may include displays. The displays may be used to display images to a user. Illustrative electronic devices that may be provided with displays are shown in FIGS. 1, 2, 3, and 4.

Figure 1:
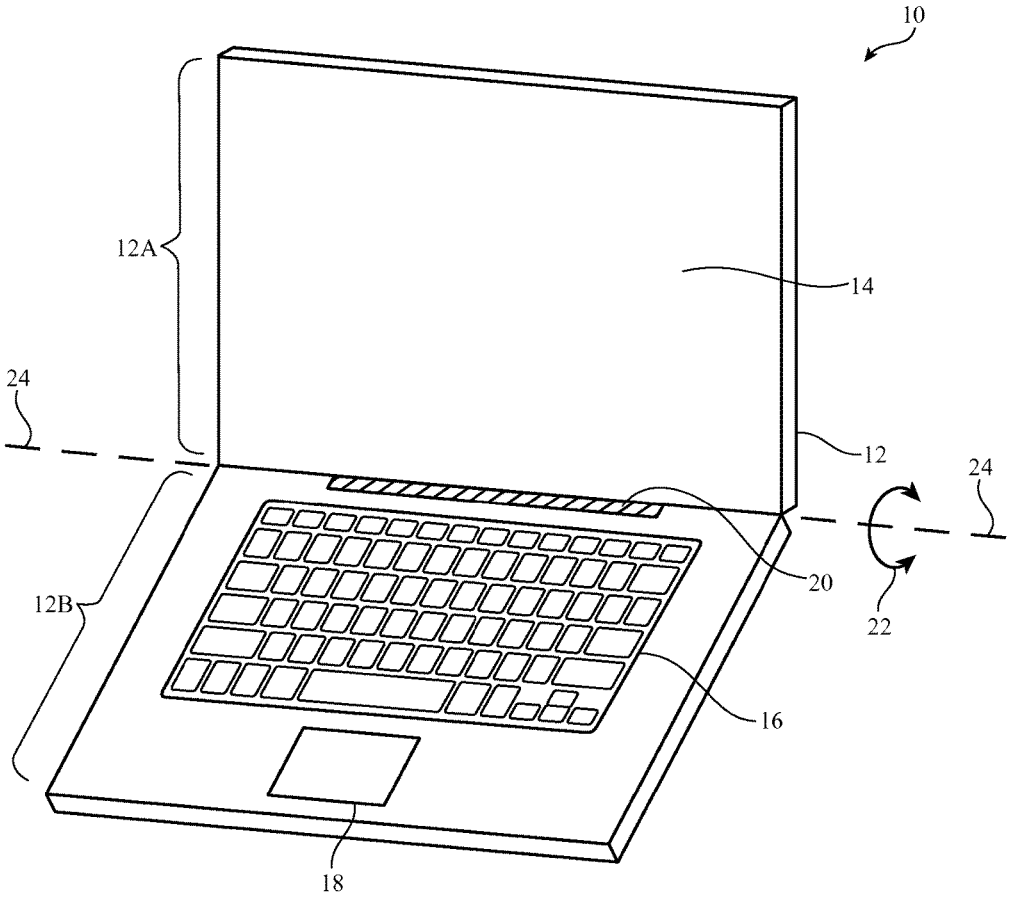
FIG. 1 is a perspective view of an illustrative electronic device such as a laptop computer with a display in accordance with an embodiment.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
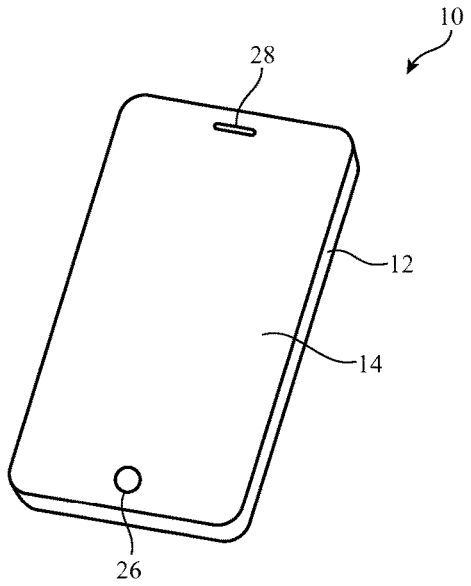
FIG. 2 is a perspective view of an illustrative electronic device such as a handheld electronic device with a display in accordance with an embodiment.

FIG. 2 shows how electronic device 10 may be a handheld device such as a cellular telephone, music player, gaming device, navigation unit, watch, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2). In compact devices such as wrist-watch devices, port 28 and/or button 26 may be omitted and device 10 may be provided with a strap or lanyard.

Figure 3:
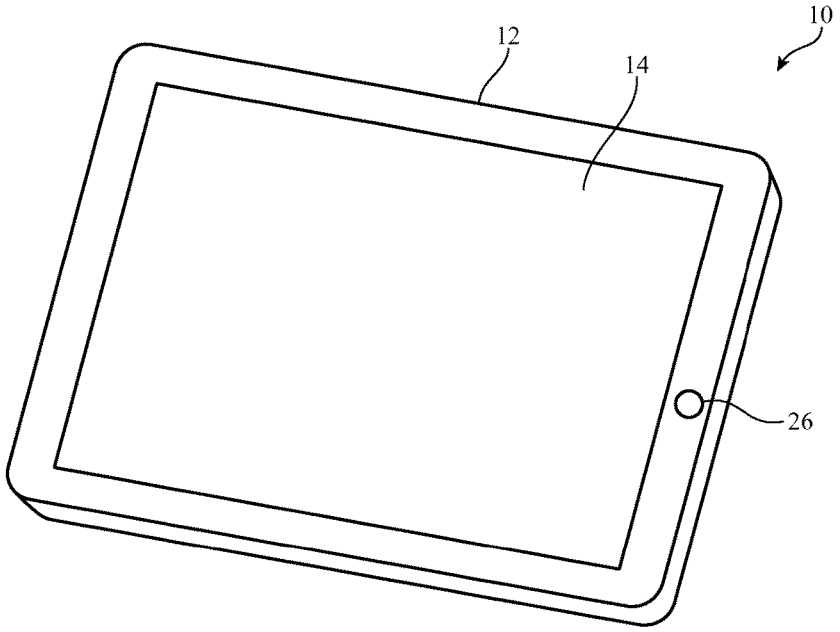
FIG. 3 is a perspective view of an illustrative electronic device such as a tablet computer with a display in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
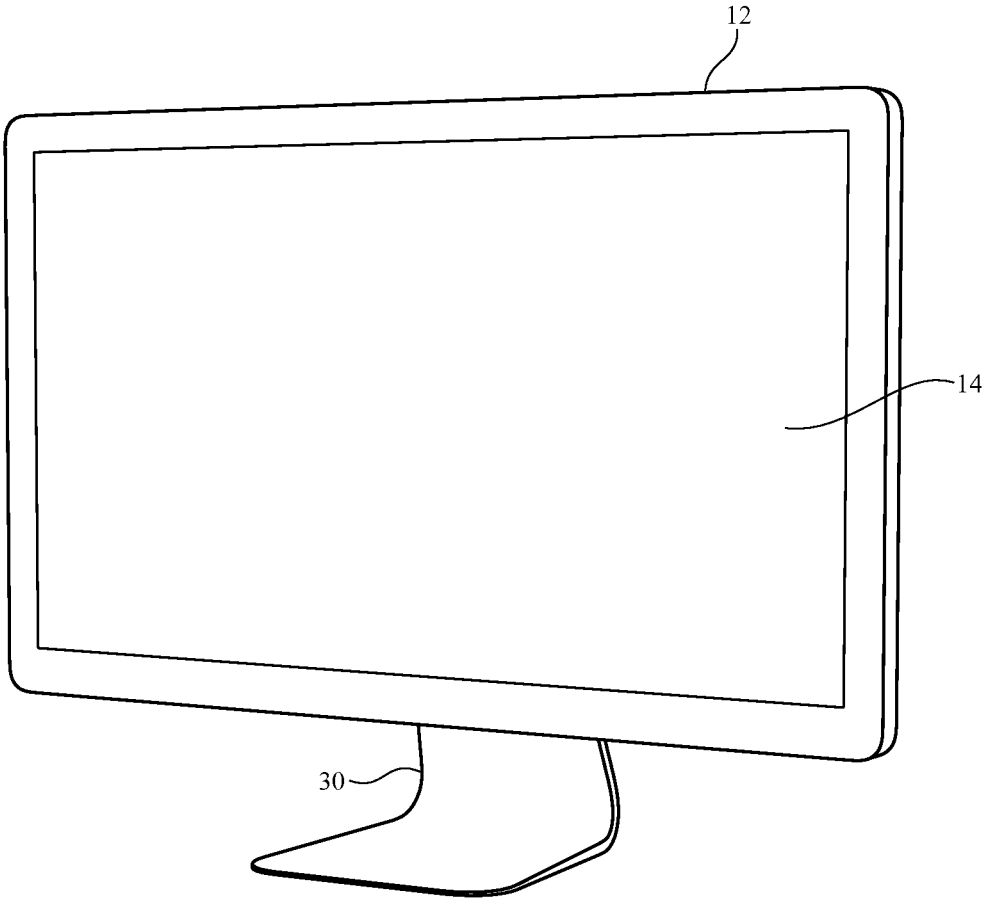
FIG. 4 is a perspective view of an illustrative electronic device such as a computer or other device with display structures in accordance with an embodiment.

FIG. 4 shows how electronic device 10 may be a display such as a computer monitor, a computer that has been integrated into a computer display, or other device with a built-in display. With this type of arrangement, housing 12 for device 10 may be mounted on a support structure such as stand 30 or stand 30 may be omitted (e.g., to mount device 10 on a wall). Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include pixels formed from liquid crystal display (LCD) components. A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
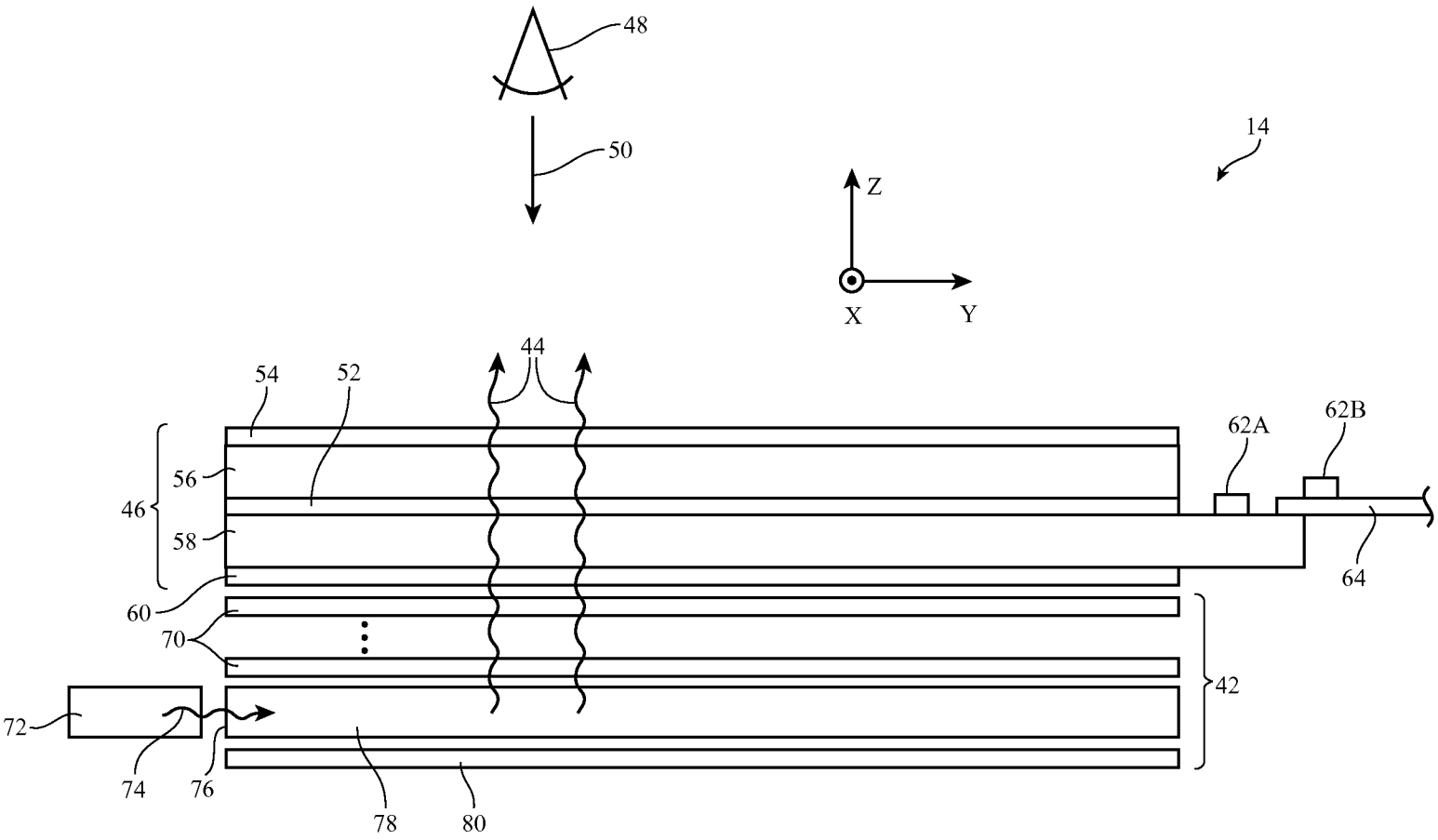
FIG. 5 is a cross-sectional side view of an illustrative display in accordance with an embodiment.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

Display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 58 and 56 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of pixel circuits based on thin-film transistors and associated electrodes (pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer. Configurations in which color filter elements are combined with thin-film transistor structures on a common substrate layer in the upper or lower portion of display 14 may also be used.

During operation of display 14 in device 10, control circuitry (e.g., one or more integrated circuits on a printed circuit) may be used to generate information to be displayed on display 14 (e.g., display data). The information to be displayed may be conveyed to a display driver integrated circuit such as circuit 62A or 62B using a signal path such as a signal path formed from conductive metal traces in a rigid or flexible printed circuit such as printed circuit 64 (as an example).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78. Light source 72 may be located at the left of light guide plate 78 as shown in FIG. 5 or may be located along the right edge of plate 78 and/or other edges of plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of plastic covered with a dielectric minor thin-film coating.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint. If desired, films such as compensation films may be incorporated into other layers of display 14 (e.g., polarizer layers).

Figure 6:
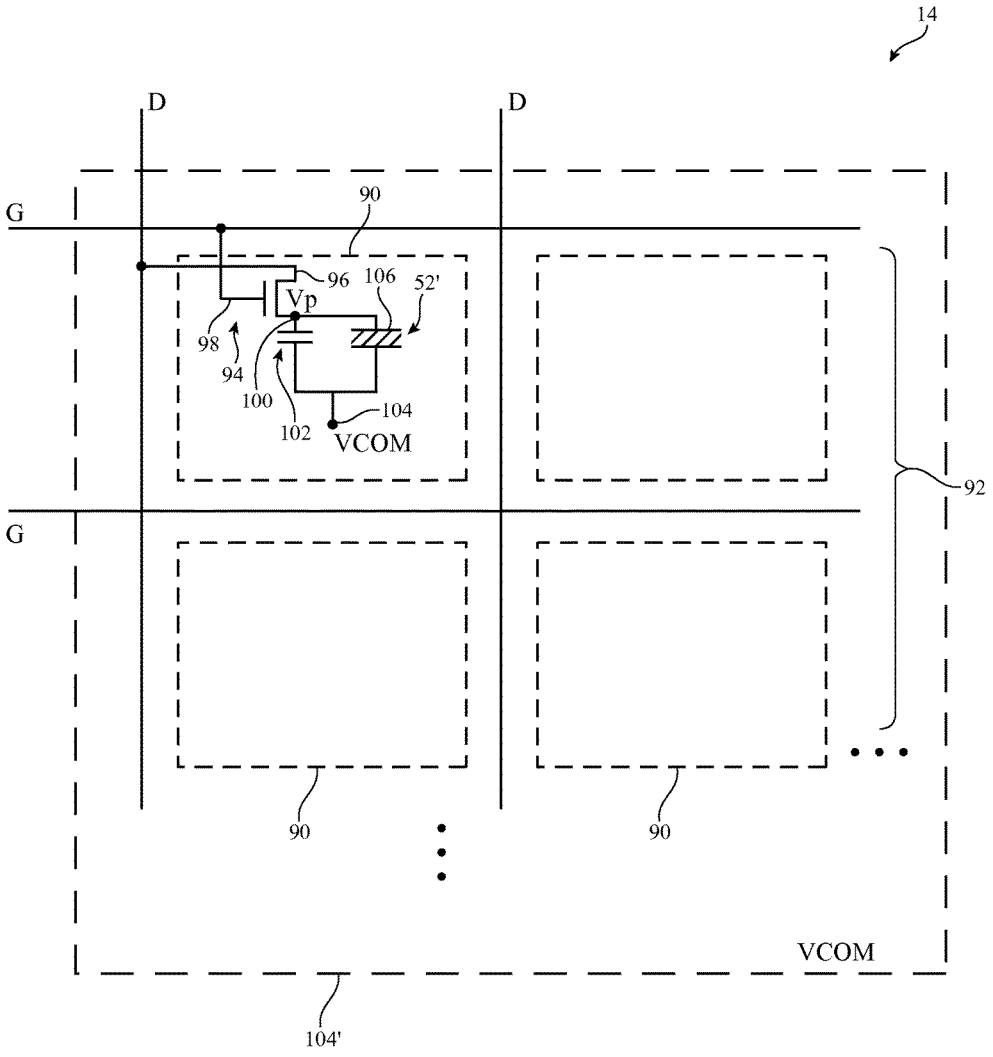
FIG. 6 is a top view of a portion of an array of display pixels configured in a 1G-1D routing arrangement in accordance with an embodiment.

As shown in FIG. 6, display 14 may include an array of pixels 90 such as pixel array 92. Pixel array 92 may be controlled using control signals produced by display driver circuitry. Display driver circuitry may be implemented using one or more integrated circuits (ICs) and/or thin-film transistors or other circuitry.

During operation of device 10, control circuitry in device 10 such as memory circuits, microprocessors, and other storage and processing circuitry may provide data to the display driver circuitry. The display driver circuitry may convert the data into signals for controlling pixels 90 of pixel array 92.

Pixel array 92 may contain rows and columns of pixels 90. The circuitry of pixel array 92 (i.e., the rows and columns of pixel circuits for pixels 90) may be controlled using signals such as data line signals on data lines D and gate line signals on gate lines G. Data lines D and gate lines G are orthogonal. For example, data lines D may extend vertically and gate lines G may extend horizontally (i.e., perpendicular to data lines D).

Gate driver circuitry may be used to generate gate signals on gate lines G. The gate driver circuitry may be formed from thin-film transistors on the thin-film transistor layer or may be implemented in separate integrated circuits. The data line signals on data lines D in pixel array 92 carry analog image data (e.g., voltages with magnitudes representing pixel brightness levels). During the process of displaying images on display 14, a display driver integrated circuit or other circuitry may receive digital data from control circuitry and may produce corresponding analog data signals. The analog data signals may be demultiplexed and provided to data lines D.

The data line signals on data lines D are distributed to the columns of display pixels 90 in pixel array 92. Gate line signals on gate lines G are provided to the rows of pixels 90 in pixel array 92 by associated gate driver circuitry.

The circuitry of display 14 may be formed from conductive structures (e.g., metal lines and/or structures formed from transparent conductive materials such as indium tin oxide) and may include transistors such as transistor 94 of FIG. 6 that are fabricated on the thin-film transistor substrate layer of display 14. The thin-film transistors may be, for example, silicon thin-film transistors or semiconducting-oxide thin-film transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor, an amorphous silicon transistor, or an oxide transistor such as a transistor formed from a semiconducting oxide such as indium gallium zinc oxide) may have a gate terminal such as gate 98 that receives gate line control signals on gate line G. When a gate line control signal is asserted, transistor 94 will be turned on and the data signal at terminal 96 will be passed to node 100 as pixel voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to help store signal Vp in pixel 90 between frames (i.e., in the period of time between the assertion of successive gate signals).

Display 14 may have a common electrode coupled to node 104. The common electrode (which is sometimes referred to as the common voltage electrode, Vcom electrode, or Vcom terminal) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide, indium zinc oxide, other transparent conductive oxide material, and/or a layer of metal that is sufficiently thin to be transparent (e.g., electrode 104 may be formed from a layer of indium tin oxide or other transparent conductive layer that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 (e.g., a display pixel electrode with multiple fingers or other display pixel electrode for applying electric fields to liquid crystal material 52') may be coupled to node 100 (or a multi-finger display pixel electrode may be formed at node 104). During operation, electrode structures 106 may be used to apply a controlled electric field (i.e., a field having a magnitude proportional to Vp-Vcom) across pixel-sized liquid crystal material 52' in pixel 90. Due to the presence of storage capacitor 102 and the parallel capacitances formed by the pixel structures of pixel 90, the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 5, be used in controlling the amount of light 44 that is transmitted through each pixel 90 in array 92 of display 14 so that image frames may be displayed on display 14.

Figure 7:
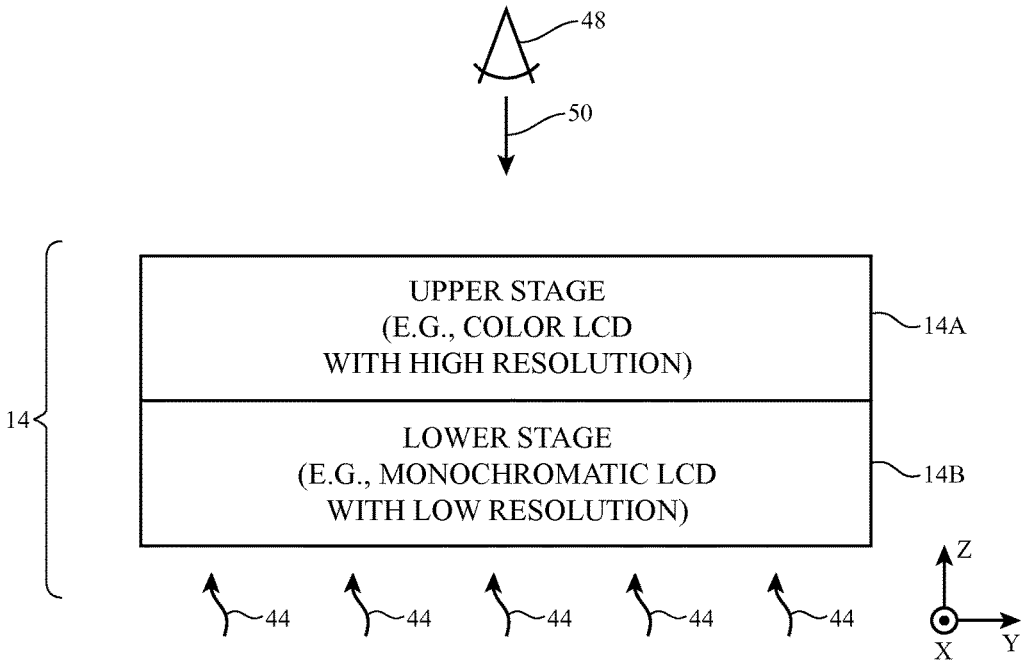
FIG. 7 is a cross-sectional side view of an illustrative two stage liquid crystal display in accordance with an embodiment.

The dynamic range of a single-stage display of the type shown in FIG. 6 can be enhanced by incorporating one or more additional liquid crystal display stages into display 14. As shown in FIG. 7, display 14 may, for example, be provided with a pair of tandem display stages such as upper stage 14A and lower stage 14B.

To provide display 14 with the ability to display images, display 14 may be provided with an array of color filter elements. The color filter element array may be formed by patterning colored photoimageable polymer areas on the underside of a transparent glass or plastic substrate (see, e.g., color filter layer 56 of FIG. 5). Only one of the display stages in display 14 need be provided with a color filter array. In the example of FIG. 7, upper stage 14A has an array of color filter elements and lower stage 14B does not have any color filter elements. Lower stage 14B is a monochromatic (gray-level) display that can modulate the intensity of backlight 44, but does not impart color information to backlight 44. Upper stage 14A contains a color filter array and has corresponding pixels to create color images for viewer 48. Because upper stage 14A has the ability to display color images, upper stage 14A may sometimes be referred to as a color stage/panel. Because lower stage 14B displays only pixels of varying shades of gray (ranging from black to white), lower stage 14B may sometimes be referred to as a monochromatic stage, shutter stage/panel, or localized dimming stage. In the illustrative configuration of FIG. 7, the upper stage of display 14 is a color stage and the lower stage of display 14 is a monochromatic stage, but the upper stage may be monochromatic and the lower stage may be a color stage, if desired.

It is not necessary for both display stages in display 14 to be high resolution stages (i.e., both stages need not have small pixel pitches). Rather, one of the stages such as upper stage 14A may have a relatively high resolution (e.g., the overall display resolution desired for display 14), whereas the other stage such as lower stage 14B may have a reduced resolution. Local stage 14B may be used to apply local dimming to dark areas of the image being displayed on display 14, rather using stage 14B to display full-resolution images. The use of localized dimming helps enhance dynamic range. For example, in an image that has dark areas, the darkness of the dark areas can be enhanced by locally dimming the dark areas with stage 14B (i.e., by creating additional dimming in addition to darkening the pixels of the dark areas with stage 14A).

In conventional two-stage LCD displays having localized dimming capabilities, the color stage and the monochromatic stage are both operated at the same refresh rate. For example, a conventional LCD display will have the color stage configured to operate at a 60 Hz refresh rate while the monochromatic stage is also configured to operate at the 60 Hz refresh rate. Display pixels in the color stage and the monochromatic stage are typically arranged using the routing configuration shown in FIG. 6. The routing arrangement of the type described in connection with FIG. 6 in which each pixel row is controlled by a respective gate line and in which each pixel column receives data from a respective data line is sometimes referred to as a 1G(gate line)/1D(data line) or "1G-1D" display control scheme.

In certain applications, it may be desirable to operate one or more stages of an LCD display at higher refresh rates. In the 1G-1D pixel routing scheme, each pixel along a column is connected to a shared data line. As a result, the amount of capacitive loading on each data line is relatively large and can limit high speed performance. This constraint worsens for high resolution panels since the number of pixels that are connected to each data line in the 1G-1D configuration is generally proportional to the panel resolution.

Figure 8:
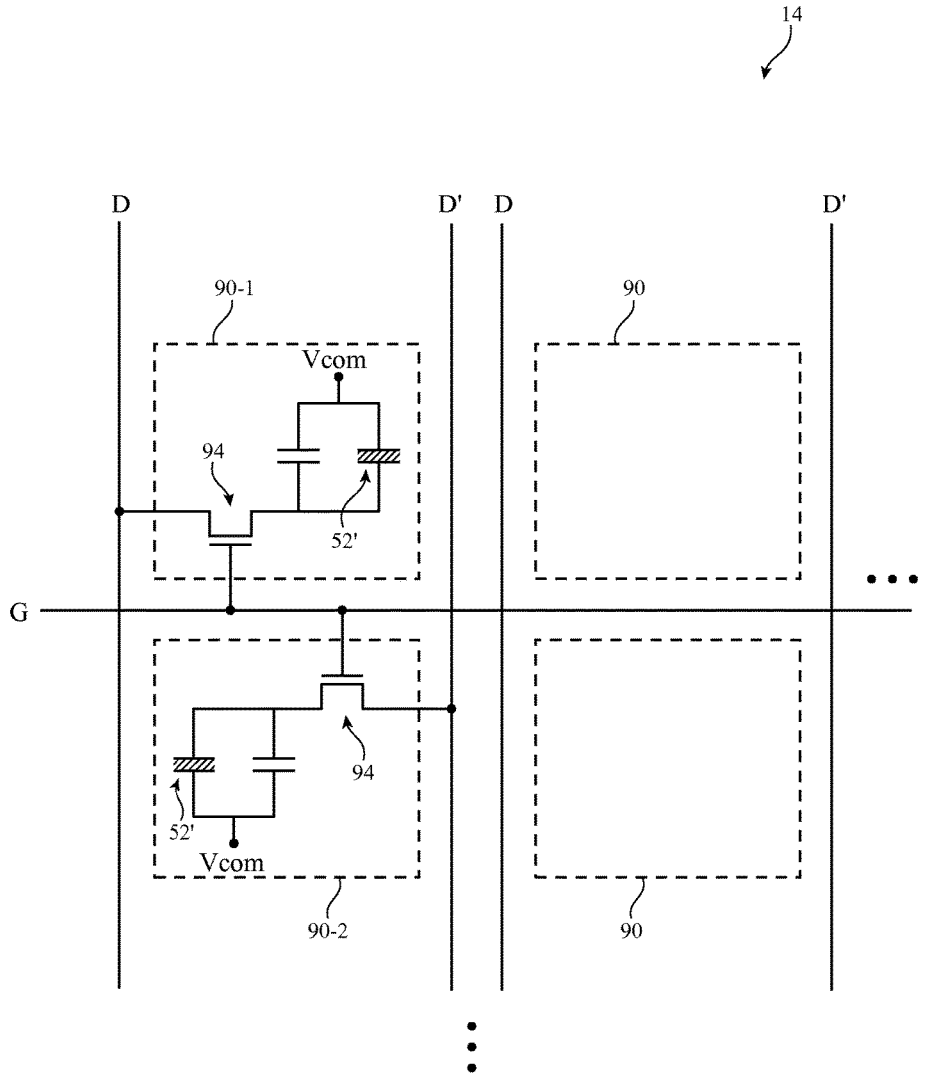
FIG. 8 is a top view of a portion of an array of display pixels configured in a 1G-2D routing arrangement in accordance with an embodiment.

FIG. 8 shows another suitable pixel routing arrangement where pixels from adjacent rows may be coupled to a shared gate line G while being coupled to different data lines. As shown in FIG. 8, a first display pixel 90-1 and an adjacent second display pixel 90-2 that are arranged along the same column may be coupled to a common gate line G. In contrast to the 1G-1D arrangement in which pixels along the same column are connected to the same data line, first pixel 90-1 may be coupled to a first data line D, whereas pixel 90-2 may be coupled to a second data line D'. This alternating connection scheme may be repeated for the entire column and for each column in the entire array of display pixels. A routing arrangement of this type in which pixels in adjacent rows can share a common gate line while being coupled to separate data lines can be referred to as a 1G(gate line)/2D (data lines) or "1G-2D" display control scheme.

In contrast to the 1G-1D routing arrangement, the 1G-2D routing arrangement can be operated at relatively higher frequencies since the number of display pixels that is connected to each individual data line D or D' is effectively divided by two, thereby reducing the capacitive loading on each of the data lines. Configuring the high resolution color stage using the 1G-2D scheme to help operate the two-stage display at a higher effective refresh rate, however, may be problematic since the 1G-2D scheme exhibits substantially reduced aperture ratios (due to the increased routing congestion introduced by the formation of the additional data lines D'). It would therefore be desirable to provide an improved two-stage display that can be at least partially operated at elevated refresh rates without suffering from reduced aperture ratio.

Figure 9:
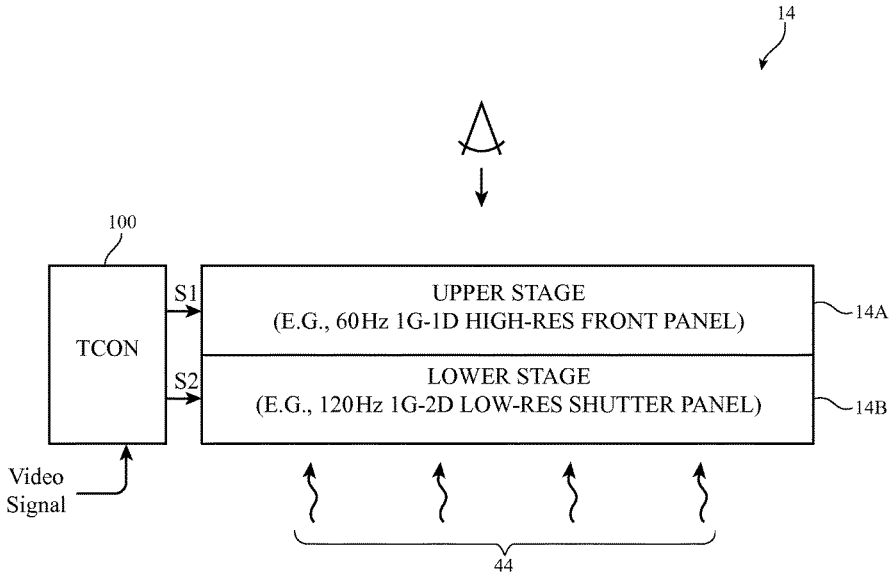
FIG. 9 is a diagram of an illustrative two stage liquid crystal display that includes a high resolution front panel with a first refresh rate and a low resolution shutter panel with a second refresh rate that is greater than the first refresh rate in accordance with an embodiment.

FIG. 9 shows a diagram of an illustrative two stage liquid crystal display 14 that includes a high resolution front (upper) stage 14A with a first refresh rate and a low resolution shutter (lower) stage 14B with a second refresh rate that is greater than the first refresh rate in accordance with an embodiment. As an example, the front panel 14A may be operated at a 60 Hz refresh rate while the shutter panel 14B may be operated at a 120 Hz refresh rate. As another example, the front panel 14A is operated at a refresh rate of 60 Hz while the shutter panel 14B is operated at a refresh rate of 240 Hz. These examples in which the refresh rate of the shutter panel is an integer multiple of that of the front panel are merely illustrative and do not limit the scope of the present invention. If desired, shutter stage 14B may be operated at any suitable refresh rate that is greater than that of front stage 14A.

In accordance with another embodiment, the front panel 14A may include an array of color filter elements and may serve as a color stage, whereas the shutter panel 14B lacks color filter elements and serves as a monochromatic stage that can be used to provide localized dimming (e.g., to apply local dimming to dark areas of the image being displayed on display 14) for backlight 44 that traverses both panels prior to reaching the user of display 14. The use of localized dimming helps enhance the dynamic range of the display.

In accordance with yet another embodiment, front panel 14A may have a relatively high resolution (e.g., the overall display resolution desired for display 14), whereas shutter panel 14B may have a reduced resolution. As an example, front panel 14A may have a resolution of 200 pixels-per-inch (ppi) while shutter panel 14B exhibits a resolution of only 80 ppi. As another example, front panel 14A may exhibit a resolution of 238 ppi while shutter panel 14B exhibits a resolution of only 43 ppi. In general, the resolution of the shutter stage may be less than the resolution of the front stage but at least 10% of the resolution of the front stage, at least 20% of the resolution of the front stage, at least 30% of the resolution of the front stage, etc.

The high resolution front panel may have display pixels configured in the 1G-1D arrangement since it does not need to operate at elevated refresh rates. On the other hand, the display pixels in the lower resolution shutter panel may be configured in the 1G-2D arrangement to help improve performance at higher refresh rates. Since the shutter panel 14B has relatively low resolution compared to the full resolution of the display (i.e., the resolution of the front panel 14A), the reduced aperture ratio resulting from the use of the 1G-2D arrangement in the shutter panel may be acceptable.

Still referring to FIG. 9, front panel 14A and shutter panel 14B may receive display data from a display timing controller (TCON) 100. Controller 100 (sometimes referred to as display control circuitry) may be formed as part of or separate from the display driver integrated circuit 62A and/or 62B described in connection with FIG. 5. Controller 100 may receive an input signal such as a video signal to be displayed on display 14 and may output a first data stream S1 to the front panel 14A and a second data stream S2 to the shutter panel 14B. In particular, controller 100 may be capable of analyzing the input video signal and to convert the input video signal into multiple data streams of appropriate resolution so that the desired image can be properly displayed by each of stages 14A and 14B. For example, consider a scenario in which an input frame has a resolution of 300 ppi while the front panel and the shutter panel have screen resolutions of 220 and 85 ppi, respectively. The display timing controller 100 may recognize the differences in resolution and may be configured to down-convert the 300 ppi input frame to output a 220 ppi image signal S1 to the front panel 14A and to down-convert the 300 ppi input frame to output an 85 ppi image signal S2 to the shutter panel 14B.

Figure 10:
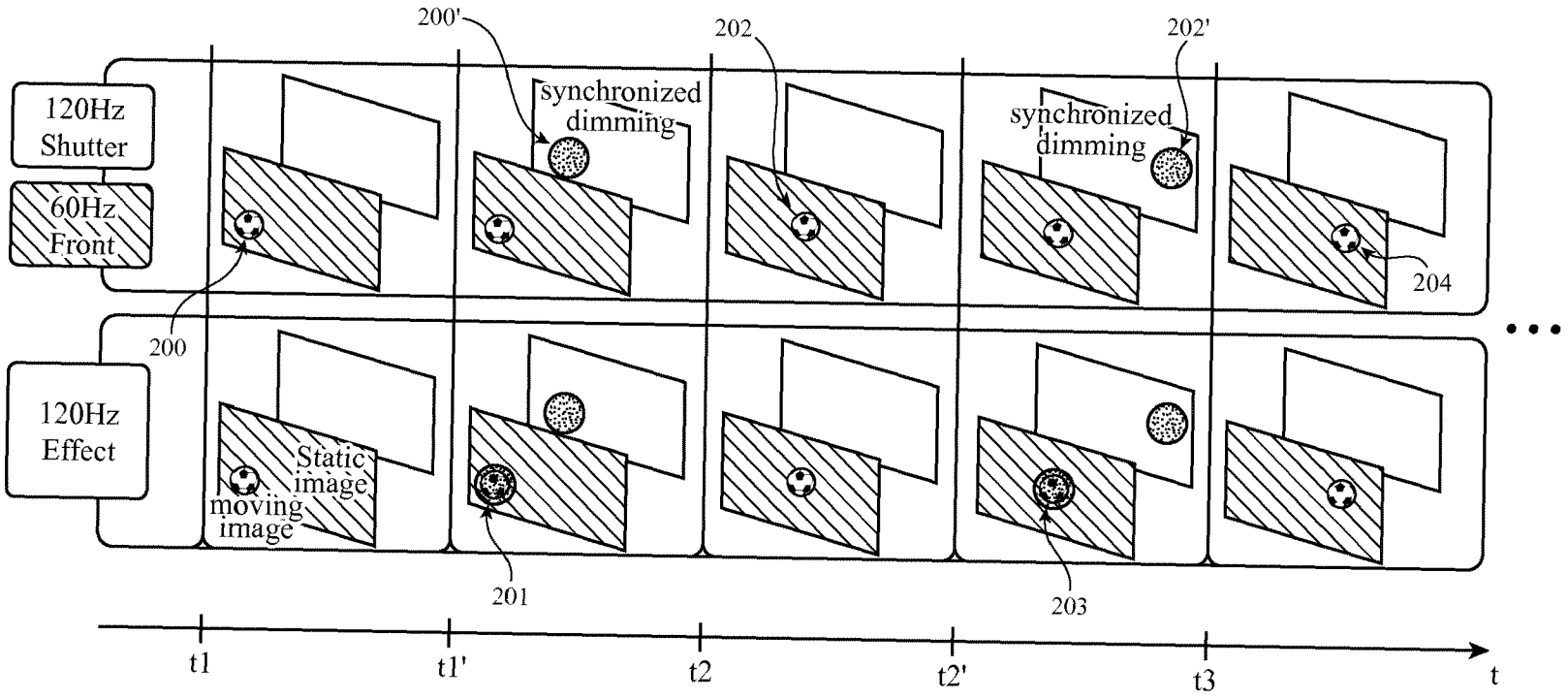
FIG. 10 is a diagram that illustrates how the shutter panel of FIG. 9 can be used to provide synchronized local dimming in accordance with an embodiment.

In accordance with an embodiment of the present invention, display timing control circuitry 100 may be configured to provide localized dimming that can be synchronized to one or more moving objects in a series of image frames to be displayed. FIG. 10 is a diagram that illustrates how the shutter panel of FIG. 9 can be used to provide synchronized local dimming. As shown in FIG. 10, the front panel may be updated at a first refresh rate (e.g., at 60 Hz) at times t1, t2, t3, etc., whereas the shutter panel may be updated at a second faster refresh rate (e.g., at 120 Hz). Since the lower-resolution monochromatic shutter panel is operated at twice the refresh rate (in this particular example), the shutter panel is able to update its output not only at times t1, t2, and t3 when the front panel is being updated, but also at time intervals in between successive front panel frames (e.g., the shutter panel is also able to update its frame content at time t1' between times t1 and t2, at time t2' between times t2 and t3, and so on).

In the example of FIG. 10, the video frames to be displayed may include a moving object such as a soccer ball at location 200. The shaded region of the frame other than the soccer ball may represent static non-moving portions of the image. From time t1 to t2, the front panel may output a first frame in which the soccer ball remains at location 200. At time t2, the front panel may be refreshed and the soccer ball may shift to a new location 202. The soccer ball will remain at location 202 until time t3. At time t3, the front panel may again be refreshed and the soccer ball may shift to yet another location 204 in the frame.

In addition to dimming certain portions of the frame that should be dark to help improve dynamic range, the shutter panel (i.e., the lower resolution monochromatic stage) may be configured to provide localized dimming that is synchronized to one or more moving objects in the video frames. As shown in the example of FIG. 10, the shutter panel may output a first frame at time t1. If the image content does not include any dark portions, the shutter panel may be configured too pass through the backlight to the front panel. If the image content does include a dark portion (omitted from FIG. 10 so as to not unnecessarily obscure the present invention), the shutter panel may be configured to provide backlight dimming that corresponds to the dark portion to help display a deeper black.

At time t1', the shutter panel may be refreshed and may insert a black portion that is synchronized to the moving soccer ball (at location 200'). This additional synchronized dimming may be independent of the luminance value of the soccer ball. In other words, this additional dimming is synchronized and tracks the location of the moving object and will be provided even if the moving object is not dark.

At time t2, the shutter panel may be refreshed and the black portion that was previously synchronized to the moving soccer ball at location 200' may be removed. At time t2', the shutter panel may again be refreshed and may insert another black portion that is synchronized to the moving soccer ball (at location 202'). At time t3, the shutter panel may be refreshed and the black portion that was previously synchronized to the moving soccer ball at location 202' may be removed. This alternating insertion of black image portions in the shutter panel may be controlled using the display controller (e.g., the display timing control circuitry of FIG. 9). The display controller may therefore be capable of analyzing incoming video frames, detecting one or more moving objects in the video frames, and then direct the shutter panel to intermittently insert black portions that are locally synchronized to the position of the moving object(s).

The use of the shutter panel to insert black image portions every other frame at the higher frequency will effectively display video frames having localized dimming that tracks moving objects at the higher frequency (e.g., at 120 Hz). For example, the effective display output will have a black portion at location 201 at time t1' (corresponding to the synchronized dimming provided by the shutter panel at location 200') and another black portion at location 203 at time t2' (corresponding to the synchronized dimming provided by the shutter panel at location 202').

In contrast to cathode ray tube (CRT) displays or other types of impulse-type displays that exhibit fast phosphor decay, liquid crystal displays are hold-type displays with relatively slow response times. When a moving object is held at a fixed position for an entire frame duration, the human eye is able to track the moving object. As a result, when the object is moved to a new position in a successive frame, the human eye is able to detect the sudden change, which is perceived as motion blur to the user. In accordance with an embodiment of the present invention, using the shutter panel to provide localized dimming that is synchronized to the moving object at alternating frames serves to emulate the impulse-type displays (e.g., the insertion of black image portions helps to decrease the eye-tracing integration time), which helps to substantially reduce motion blur.

The example of FIG. 10 in which the additional localized dimming is synchronized to a portion of the frame that coincides with the moving object is merely illustrative and does not serve to limit the scope of the present invention. If the moving object is bigger, the corresponding region dimmed using the shutter panel may also be bigger. If the moving object is smaller, the corresponding region dimmed by the shutter panel may be smaller. The shape of the synchronized dimming region need not be circular (as shown in FIG. 10). In general, the shape of the synchronized dimming area that is provided on the shutter panel may be circular, rectangular, or any suitable polygonal or other odd shape that can at least partially cover the moving object.

Figure 11:
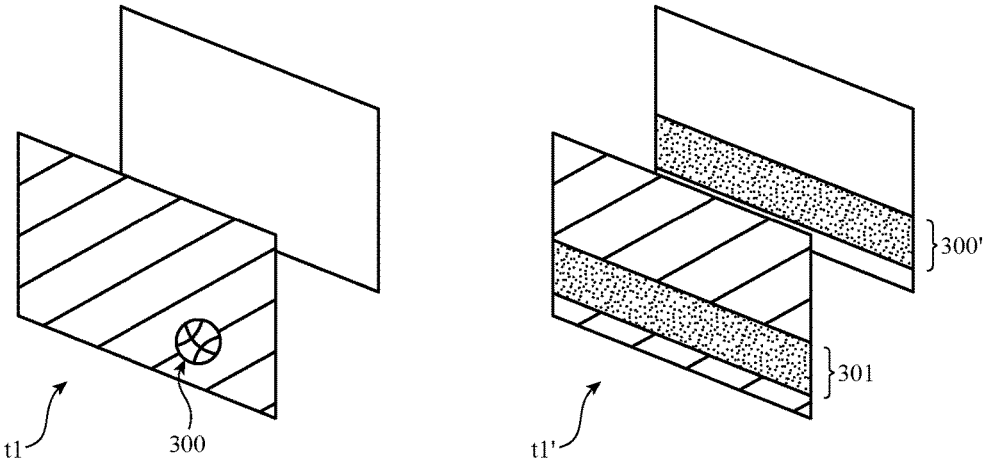
FIG. 11 is a diagram that illustrates how local dimming can be implemented using the shutter panel to insert a horizontal blanking portion in a frame in accordance with an embodiment.

FIG. 11 shows another suitable embodiment in which the shutter panel provides motion-synchronized dimming in the form of a horizontal blanking portion. As shown in FIG. 11, the shutter panel may be configured to insert (at time t1') a horizontal blanking region 300' corresponding to the moving object at frame location 300. This will effectively result in the display output being dimmed in portion 301, which can help reduce the perceived motion blur associated with the moving object.

Figure 12:
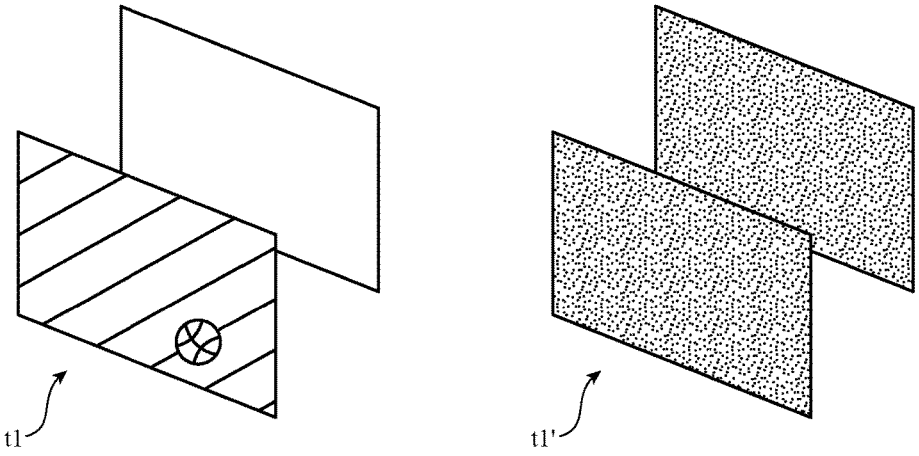
FIG. 12 is a diagram that illustrates how local dimming can be implemented using the shutter panel to insert a blank frame in accordance with an embodiment.

FIG. 12 shows yet another suitable embodiment in which the shutter panel provides motion-synchronized dimming by insertion a blank frame. As shown in FIG. 12, the shutter panel may be configured to insert (at time t1') a black frame in response to detection a moving object in the video frames. This will effectively result in the display output being completely blacked out at time t1', which can help reduce the perceived motion blur associated with the moving object. The black frame may only be inserted when a moving object is detected. If there is no moving object in the image content to be displayed, the shutter panel need not insert any black frames. If desired, black frames may be inserted whether or not a moving object is detected to help obviate the need for the actual detection of moving objects.

Figure 13:
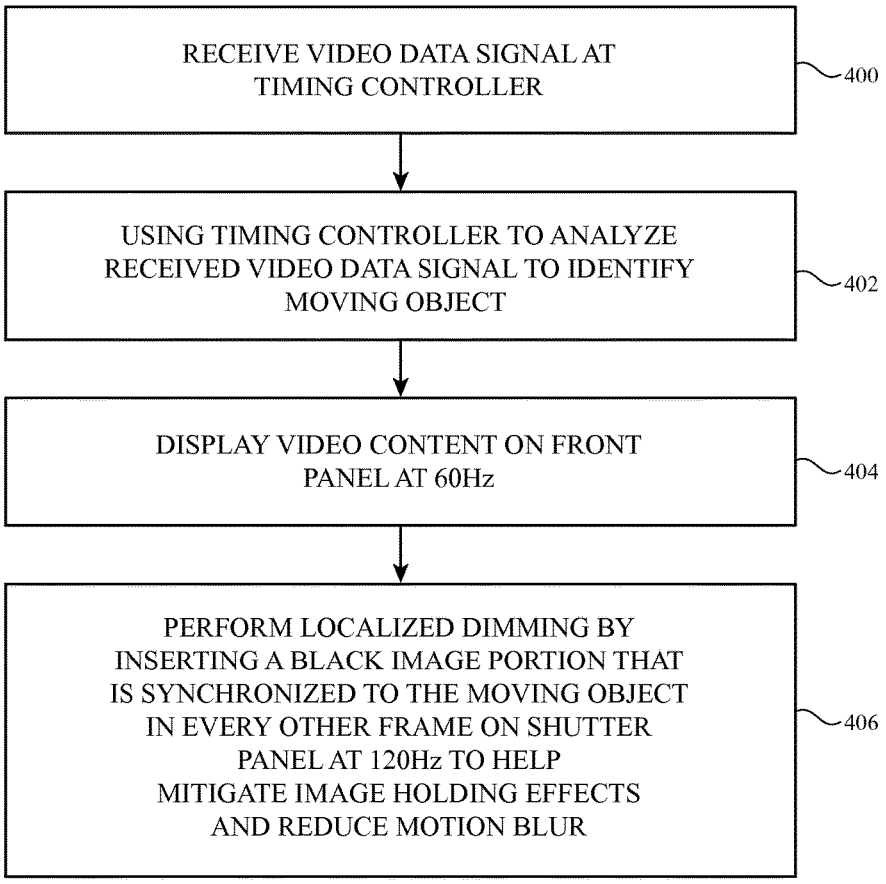
FIG. 13 is a flow chart of illustrative steps for operating a liquid crystal display of the type shown in FIG. 9 to perform synchronized local dimming in accordance with an embodiment.

FIG. 13 is a flow chart of illustrative steps for operating a liquid crystal display of the type shown in FIG. 9 to perform synchronized local dimming. At step 400, the timing controller (e.g., timing controller 100 of FIG. 9) may receive the video data signal to be displayed. At step 402, the timing controller may be configured to analyze the received video data signal and identifying any moving object(s) in the video frames to be displayed.

At step 404, the video content may be displayed on the front panel (e.g., the upper stage panel 14A in FIG. 9) at a nominal refresh rate such as 60 Hz. While the front panel is displaying video content at the 60 Hz nominal refresh rate, localized dimming may be performed by inserting a black image portion that is synchronized to the detected moving object(s) in every other frame on the shutter panel (e.g., the lower stage panel 14B of FIG. 9) at an elevated refresh rate such as 120 Hz. Operating the dual stage liquid crystal display in this way can help mitigate image holding effects and reduce motion blur.

The foregoing is merely illustrative and various modifications can be made by those skilled in the art without departing from the scope and spirit of the described embodiments. The foregoing embodiments may be implemented individually or in any combination.

What is claimed is:

1. A display, comprising: a color upper stage having color filter elements; a monochromatic lower stage that lacks color filter elements, wherein the color upper stage operates at a first refresh rate, and wherein the monochromatic lower stage operates at a second refresh rate that is different than the first refresh rate; a backlight unit that provides backlight to the color upper stage and the monochromatic lower stage, wherein the monochromatic lower stage is interposed between the backlight unit and the color upper stage; and a timing controller that receives video signals, that identifies a moving object in the video signals, and that performs localized dimming that is synchronized with the moving object, wherein the color upper stage displays the moving object, wherein the timing controller performs the localized dimming by inserting a black portion into the monochromatic lower stage that overlaps and prevents the backlight from reaching the moving object in the color upper stage, wherein the black portion in the monochromatic lower stage tracks the moving object as the moving object moves in the color upper stage to maintain the overlap between the black portion and the moving object, and wherein the black portion is surrounded by an illuminated portion.

2. The display defined in claim 1, wherein the second refresh rate is an integer multiple of the first refresh rate.

3. The display defined in claim 2, wherein the second refresh rate is two times the first refresh rate.

4. The display defined in claim 1, wherein the black image portion is inserted into the monochromatic lower stage every other frame.

5. The display defined in claim 1, wherein the timing controller performs localized dimming only when the moving object is detected in the video signals.

6. A method for operating a two-stage display, the method comprising: receiving video data at a timing controller in the two-stage display, wherein the two-stage display includes a color stage having a first resolution and a monochromatic stage having a second resolution that is less than the first resolution; using the timing controller to analyze the video data to detect a moving object; and in response to detecting the moving object, reducing motion blur by inserting a black image portion that overlaps the moving object and an illuminated portion that surrounds the black portion into the monochromatic stage every other frame while operating the monochromatic stage at a first refresh rate and while driving the color stage with the video data at a second refresh rate that is less than the first refresh rate, wherein the inserted black image portion tracks the location of the moving object.

7. The method defined in claim 6, wherein inserting the black image portion comprises using the monochromatic stage to display a black object that overlaps with the moving object every other frame.

8. The method defined in claim 6, wherein inserting the black image portion comprises inserting the black image portion only when a moving object is detected.

9. Display circuitry, comprising: a front liquid crystal panel that displays each of a plurality of frames for a respective period of time at a first refresh rate, and wherein the front liquid crystal panel includes a first liquid crystal layer; a lower liquid crystal shutter panel that operates at a second refresh rate that is different than the first refresh rate, wherein the lower liquid crystal shutter panel displays multiple different frames during each respective period of time for which each of the plurality of frames is displayed on the front liquid crystal panel, wherein the lower liquid crystal shutter panel includes a second liquid crystal layer; and a timing controller that receives video data and analyzes the video data to detect a moving object, wherein the front liquid crystal panel displays the moving object in the plurality of frames, and wherein the timing controller reduces motion blur associated with the moving object by selectively performing localized dimming that includes inserting a black portion into the lower liquid crystal shutter panel that tracks the moving object in the front liquid crystal panel, wherein the black portion is surrounded by an illuminated portion.

10. The display circuitry defined in claim 9, wherein the second refresh rate is an integer multiple of the first refresh rate.

11. The display circuitry defined in claim 9, wherein the front liquid crystal panel and the lower liquid crystal shutter panel have different data line architectures.

12. The display circuitry defined in claim 11, wherein the front liquid crystal panel includes a first array of display pixels arranged in rows and columns, wherein the lower liquid crystal shutter panel includes a second array of display pixels arranged in rows and columns, wherein each column of display pixels in the first array is coupled to a first number of data lines, and wherein each column of display pixels in the second array is coupled to a second number of data lines that is different than the first number of data lines.

13. The display circuitry defined in claim 9, wherein the front liquid crystal panel has a first resolution, and wherein the lower liquid crystal shutter panel has a second resolution that is less than the first resolution but at least 10% of the first resolution.

* * * * *